United States Patent [19]

Seegers

[11] 4,285,177

[45] Aug. 25, 1981

[54] REINFORCED TREAD ASSEMBLY

[75] Inventor: Glen A. Seegers, Wheaton, Ill.

[73] Assignee: American Stair Corporation, Inc., Willow Springs, Ill.

[21] Appl. No.: 110,345

[22] Filed: Jan. 7, 1980

[51] Int. Cl.[3] ..... E04F 11/12; B44D 5/08

[52] U.S. Cl. ..... 52/179; 52/182; 428/688

[58] Field of Search ..... 428/149, 60, 310, 457, 428/538, 174; 52/182, 188–191, 177, 179; D25/69

[56] References Cited

U.S. PATENT DOCUMENTS

| | | | |
|---|---|---|---|
| 1,244,021 | 10/1917 | Bois | 52/182 |
| 1,497,058 | 6/1924 | Barriball | 52/190 |
| 1,566,042 | 12/1925 | Schmidt | 52/182 |
| 3,370,387 | 2/1968 | Sivley | 52/189 |
| 3,616,589 | 11/1971 | Sherard | 52/659 |
| 3,672,106 | 6/1972 | Mulitz | 52/189 |
| 3,808,085 | 4/1974 | Givens | 52/659 |

*Primary Examiner*—Paul J. Thiebodeau

*Attorney, Agent, or Firm*—Edward D. Gilhooly

[57] ABSTRACT

Reinforced tread assemblies for a stairway system having a tread formed of a reinforced concrete material and supported on a metal base member bonded to at least a portion of the underside of the tread to create a laminated construction. A nose section is integrally coupled to the base section and extends upward to protect the front portion of the tread from damage during use.

10 Claims, 4 Drawing Figures

REINFORCED TREAD ASSEMBLY

BACKGROUND OF THE INVENTION

This invention relates in general to building structures and, in particular, to an improved stairway assembly.

More specifically, without restriction to the particular use which is shown and described, this invention relates to an improved reinforced tread assembly for use in a stairway system and the like and employing a reinforced concrete tread supported by a novel technique to increase the strength of the system and to protect the tread from damage. The improved reinforced tread assembly herein disclosed provides a sturdy and lightweight structure, achieving superior results in use.

Concrete has long been a commonly used material forming the whole or part of a stairway structure. Concrete has been conventionally employed in the prior art, because it offers a sturdy and durable material providing a long life of service, while being subjected to constant pedestrian travel and various loading conditions. The utilization of concrete to form the treads and structure of stairways and the like does present several disadvantages, which cause significant difficulties to the manufacturer of the stair system as well as the installer at the job site. Concrete suffers from an inherent weakness in tensile strength requiring the use of internal reinforcing agents in the form of rods and the like to provide adequate structural integrity. An assembled steel and concrete stairway creates a relatively heavy structure in order to attain a system possessing suitable strength. Such an assembled structure is cumbersome for shipment to a construction site and difficult to erect. One technique employed to overcome the assembled weight problems of prior art stairway systems is to ship the concrete stair treads and other components separately, or alternatively, form the stairway itself at the job site by pouring unset concrete into an erected formwork. Such a solution is unsatisfactory, because it requires time consuming and uneconomic construction effort. Thus, the use of conventional concrete involves the use of a relatively heavy material for a given load capacity, which is uneconomical to ship and inconvenient to install.

In recent years, a material has been introduced to the marketplace consisting of a cement reinforced by glass fiber material and providing a lightweight, and highly strong structure. The use of such a lightweight and sturdy reinforced concrete is very desirable for adoption in stairways and the like, since the complete stairway, with treads installed, can readily be shipped from the manufacturer to the construction site. Such reinforced concrete is also advantageous for incorporation in a stairway system, since the quantity of material needed to attain a suitable degree of strength is much less in comparison to normal concrete, even when reinforced with structural elements, thus reducing deadweight. Potentially, the use of a glass fiber reinforced material as a tread of a stairway could thus be highly beneficial as a component of a stairway system. However, fiberglass concrete suffers from several problems which have prevented its previous effective utilization in stairway structures. Reinforced concrete is subject to undesirable chipping, particularly at its exposed edges such as are present in a tread member. Further, difficulty has previously been encountered in achieving an efficient and suitable attachment of the glass fiber reinforced cement tread to the stairway system by a simplified and economical technique. In addition to the foregoing problems, concrete is also subject to undesired penetration or damage under high impact or loadings which can be detrimental to its effective use. Thus, it is desirable to provide an improved system by which a fiberglass reinforced concrete tread can be utilized in a stairway system and the like such that the aforementioned problems are overcome by an economical and lightweight, sturdy construction.

SUMMARY OF THE INVENTION

It is, therefore, an object of this invention to improve stairway structures.

Still another object of this invention is to improve the mounting of a reinforced concrete tread to a stairway system.

A further object of this invention is to prevent damage to exposed surfaces of a reinforced concrete tread utilized in a stairway system.

Still another object of this invention is to improve the strength and impact resistance of the reinforced concrete material utilized as the tread of a stairway and the like.

These and other objects are attained in accordance with the present invention wherein there is provided an improved reinforced tread assembly and the like having treads formed of a reinforced substance such as glass fiber reinforced concrete. The invention of the application provides an economical and lightweight system to permit complete assembly of the stairway by a manufacturer for shipment and ready assembly at the construction site. The components of the invention may also be shipped unassembled and easily erected at the job site. The stairway system of the invention includes an improved mounting of the fiberglass reinforced concrete treads to the stairway system in conjunction with a metal sub-tread thereof such that durability of the tread is increased and added strength and resistance to impact is achieved. The assembly of the invention combines the advantages of both reinforced concrete and metal through the formation of a laminated tread comprising these materials.

BRIEF DESCRIPTION OF THE DRAWINGS

Further objects of the invention together with additional features contributing thereto and advantages accruing therefrom will be apparent from the following description of the preferred embodiments of the invention which are shown in the accompanying drawings with like reference numerals indicating corresponding parts throughout, wherein.

DESCRIPTION OF THE PREFERRED EMBODIMENTS

Figure 1:
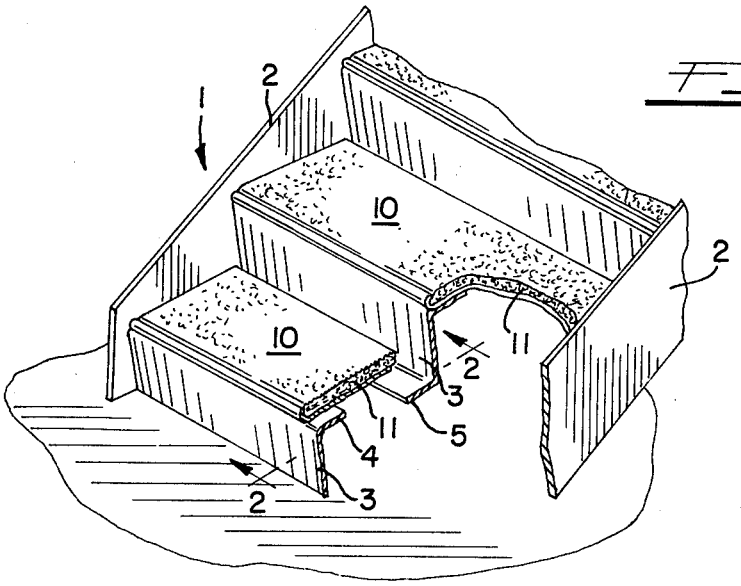
FIG. 1 is a perspective illustration of a portion of a stairway system employing the improved reinforced tread assembly of the invention.
Figure 2:
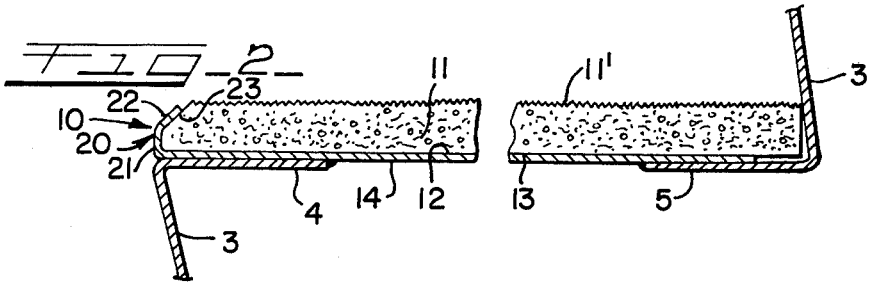
FIG. 2 is a sectional end view of the reinforced tread assembly of FIG. 1 illustrating its mounting of the treads of the stairway system.

Referring now to FIG. 1, there is illustrated a stairway structure utilizing the improved reinforced tread assembly of the invention. The stairway structure 1 is formed by a pair of parallel extending, spaced stringers 2 suitably supported at each end and laterally interconnected by a plurality of risers 3, affixed to the stringers 2 along their longitudinal extent by any suitable technique, such as by welding and the like. As best shown in FIG. 2, the risers 3 include upper and lower bent sections to form respective horizontal flanges 4 and 5, such that the upper flange 4 of one riser is aligned horizontally with the lower flange 5 of the adjacent riser.

Referring to FIG. 2, there is shown the improved reinforced tread assembly 10 employing a reinforced concrete tread 11 constructed of a concrete material reinforced by glass fibers and in the form of a panel member. Such galss fiber reinforced concrete is lightweight, but provides high strength and is commercially available. Other reinforced materials of similar strength characteristics may be used in the improved reinforced tread assembly 10 of the invention, if desired. The tread 11 forms an upper pedestrian bearing surface 11' which can be treated by sandblasting and the like to achieve an anti-slip property for safety considerations. The bottom or underside surface 12 of the reinforced tread 11 is laminated into coupling relationship with a sub-tread or base member 13 formed of a more rigid substance, such as, for example, a sheet of metal which overlaps the entire underside surface 12. It is also within the scope of the invention to alternatively dispose the base member 13 over a portion of the bottom surface 12 through the use of perforations in the base member 13 or the use of base member having a smaller surface area than the bottom of the tread. The base member 13 may be bonded to the underside 12 of the tread 11 by any suitable adhesive agent to form a laminate to increase the overall strength of the reinforced concrete tread 11 to render the tread more impermeable and resistant to impact and increase its strength properties. The exposed bottom surface 14 of the base member 13 is adapted to bear against the respective pair of flanges 4 and 5 created by adjacent risers 3 of the stairway system and may be affixed thereto by spot welding and the like. Alternatively, a screw assembly (not shown) may bolt each of the tread assemblies to the respective flanges of the risers if desired.

The front end portion of the base member 13 is bent upward to form a nose section 20 and includes a pair of angularly oriented sections 21 and 22. The lower section 21 is disposed in a substantially vertical plane adjacent to the front face of the tread 21 and the upper section 22 extends upward from the lower section 21 at a selected angular relationship such as, for example, 45°. The exposed upper corner edge of the reinforced concrete tread 12 is beveled to form a corner surface surface 25 such that the angularly oriented upper section 22 of the nose assembly lies in contact therewith in a bonded relationship through use of an adhesive and the like. The lower section 21 can also be bonded to the front surface of the tread 11 if desired. The nose section functions to protect the exposed part of the tread 11 and attain a durable component of the stairway. Thus, the likelihood of chipping or damage to the tread during its continued use is greatly alleviated by the invention of the application.

Figure 3:
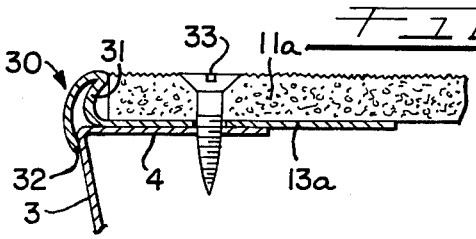
FIG. 3 is a sectional illustration of another embodiment of the reinforced tread assembly of the invention.

Referring to FIG. 3, there is illustrated another embodiment of improved reinforced concrete tread assembly of the invention for use in a stairway such as shown in FIG. 1. The tread **11*a* of the embodiment of FIG. 3 is similar in construction to that illustrated in FIGS. 1 and 2, except that the reinforced concrete tread is not beveled at the upper outer corner. To protect the exposed narrow end section of the reinforced concrete tread 11*a*, a sheet metal molding 30 having a cross-sectional configuration, in the shape of a substantially sideway oriented T, integrally extends upward from base member 13*a* with curved portion 31 to contact with the upper corner of the tread 11*a* and the molding 30 is bent back and downward to terminate at end 32 adjacent the front face of riser 3. The base member 13*a* extends in the embodiment of FIG. 3 beneath only a portion of the underside of tread 11*a*. The base member may be bonded thereto for increase securement, if desired. As shown in FIG. 3, the tread 11*a* is illustrated as being secured to the flange 4 by means of sheet metal screw 33 and is bonded by a suitable adhesive directly to flange 5. Alternatively, the base member 13*a* may be bonded to the flange 4 by spot welding and the like as previously described in connection with the embodiment of FIG. 2. It is within the scope of the invention to dispose the base member 13*a* over the entire underside of tread 11*a* in a bonded relationship for securement to the riser flanges 4 and 5 in a manner also previously described in connection with the tread assembly shown in FIG. 2**.

Figure 4:
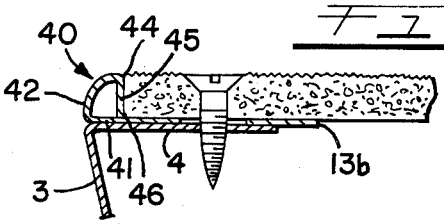
FIG. 4 is an end sectional illustration of still another embodiment of the reinforced tread assembly of the invention.

Referring to FIG. 4, there is illustrated another embodiment of the tread assembly of the invention similar to that described in conjunction with FIG. 3. The molding forming the nose section 40 of tread **11*b* is in the form of a modified "D" shape in cross-section created by an outward extension 41 of base member 13*b* which terminates with an upwardly curved portion 42 extending to the upper corner 44 of the tread 11*b*. A section 45 then extends downward in parallel relationship to the front edge surface of tread 11*b* to bottom edge 46. The section 45 may be bonded to the tread 11*b*, if desired. The base member 13*b* may extend partially or totally beneath the underside of the tread and is capable of being attached to the flanges by the alternative methods discussed with respect to the embodiment of FIG. 3**.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A lightweight, reinforced concrete tread assembly for a stairway, comprising a tread member formed of a glass reinforced concrete material, said tread member having an upper face forming an upper tread surface, a front surface and an underside face, base means having a base member coupled in a laminated relationship to at least a portion of the underside of said tread member, said base member acting to reinforce said tread member and to render said tread member more impermeable and resistant to impact and forming a composite strengthened tread assembly in conjunction with said tread member, means for bonding said base member to said tread member to form said composite strengthened tread assembly, said base means including a nose section integrally coupled to said base member in a continuous relationship, said nose section extending upward in close proximity to said front surface to a location adjacent said upper surface to protect said tread member, a pair of risers forming at least a part of a stairway structure, said risers having respective flanges forming aligned spaced horizontal surfaces, and said laminated tread member and base member being carried on said horizontal surfaces with said base member being disposed between said reinforced tread and at least one of said horizontal surfaces.

2. The reinforced concrete tread assembly of claim 1 wherein said tread member includes a beveled edge surface extending between said upper tread surface and said front surface.

3. The reinforced concrete tread assembly of claim 2 wherein said nose section includes a portion contacting said beveled edge surface of said tread member.

4. The reinforced concrete tread assembly of claim 3 wherein said nose section covers said front surface and said beveled edge surface of said tread member.

5. The reinforced concrete tread assembly of claim 1 wherein said base member contacts the entire underside face of said stair tread.

6. The reinforced concrete tread assembly of claim 1 wherein said nose section includes an approximate T-shape, said T-shape including a front section arranged in spaced relationship to said front surface of said tread member.

7. The reinforced concrete tread assembly of claim 1 wherein said nose section includes an approximate D-shape, said D-shape having a front section arranged in spaced relationship to said front surface of said tread member.

8. The reinforced concrete tread assembly of claim 2 further including means to bond a portion of said nose section to said beveled edge surface.

9. The reinforced concrete tread assembly of claim 1 wherein said tread is directly bonded in contacting relationship to at least one of said risers.

10. The reinforced concrete tread assembly of claim 1 further including means to bond said nose section to at least a portion of said front surface.

* * * * *